US012529159B2

(12) United States Patent
Xu et al.

(10) Patent No.: US 12,529,159 B2
(45) Date of Patent: Jan. 20, 2026

(54) CO-ELECTROPLATING Sn—Bi ALLOY SOLDER FOR 3D-IC LOW-TEMPERATURE BONDING

(71) Applicant: Hong Kong Applied Science and Technology Research Institute Company Limited, Hong Kong (HK)

(72) Inventors: Minjie Xu, Hong Kong (HK); Xunqing Shi, Hong Kong (HK); Pau Yee Lim, Hong Kong (HK); Tsz Fung Au, Hong Kong (HK)

(73) Assignee: Hong Kong Applied Science and Technology Research Institute Company Limited, Hong Kong (HK)

( * ) Notice: Subject to any disclaimer, the term of this patent is extended or adjusted under 35 U.S.C. 154(b) by 28 days.

(21) Appl. No.: 18/390,167

(22) Filed: Dec. 20, 2023

(65) Prior Publication Data

US 2025/0034740 A1 Jan. 30, 2025

Related U.S. Application Data

(60) Provisional application No. 63/513,118, filed on Jul. 12, 2023.

(51) Int. Cl.

| | |
|---|---|
| ***C25D 3/32*** | (2006.01) |
| ***C25D 3/60*** | (2006.01) |
| ***C25D 17/14*** | (2006.01) |

(52) U.S. Cl.

CPC ..... *C25D 3/32* (2013.01); *C25D 3/60* (2013.01); *C25D 17/14* (2013.01)

(58) Field of Classification Search

None

See application file for complete search history.

(56) References Cited

U.S. PATENT DOCUMENTS

| | | | |
|---|---|---|---|
| 3,663,384 | A | 5/1972 | Lescure |
| 5,039,576 | A | 8/1991 | Wilson |

(Continued)

FOREIGN PATENT DOCUMENTS

| | | | |
|---|---|---|---|
| CN | 101538726 | A | 9/2009 |
| CN | 105696040 | A | 6/2016 |

(Continued)

OTHER PUBLICATIONS

ISR and Written Opinion, PCT/CN2023/142793, Apr. 10, 2024.

(Continued)

*Primary Examiner* — Wojciech Haske

(74) *Attorney, Agent, or Firm* — Stuart T. Auvinen; gPatent LLC

(57) ABSTRACT

Reagents A, B, C are added to an electrolyte bath for co-depositing tin-bismuth alloys (Sn—Bi). Reagent A is a larger acid molecule that binds to $Bi^{3+}$ ions while reagent B is a small molecule that binds to the $Bi^{3+}$ ions in spaces between the reagent A molecules. Reagents A and B reduce the standard electrode potential difference of Sn and Bi to permit co-deposition rates that yield a Sn—Bi alloy of 30-70% Bi by weight, around the 58% eutectic, with an alloy melting point below 180° C. for use as a low-temperature solder. Reagent C has a hydrophilic end that attaches to the electrode surface and a hydrophobic tail that is an aliphatic chain that attracts hydrogen gas, removing $H_2$ gas from the electrode surface. Reagent C improves alloy microstructure by removing $H_2$ gas generated at the cathode that can block $Bi^{3+}$ ions from uniformly depositing on the surface.

13 Claims, 17 Drawing Sheets

(56) References Cited

U.S. PATENT DOCUMENTS

| | | | | |
|---|---|---|---|---|
| 6,176,996 | B1 | 1/2001 | Moon | |
| 6,726,827 | B2 | 4/2004 | Khaselev et al. | |
| 7,341,949 | B2 | 3/2008 | Chien et al. | |
| 2003/0132122 | A1 | 7/2003 | Khaselev et al. | |
| 2006/0096867 | A1 | 5/2006 | Bokisa et al. | |
| 2015/0267310 | A1* | 9/2015 | Ikumoto | C25D 3/60 205/253 |
| 2019/0368063 | A1 | 12/2019 | Yamaguchi et al. | |
| 2021/0040636 | A1* | 2/2021 | Watanabe | C25D 7/00 |

FOREIGN PATENT DOCUMENTS

| | | | |
|---|---|---|---|
| EP | 1467004 | B1 | 3/2009 |
| JP | 2000080493 | A | 3/2000 |
| JP | 2006052421 | A | 2/2006 |
| JP | 2006117980 | A | 5/2006 |
| JP | 2017031447 | A | 2/2017 |
| WO | WO9004048 | A | 4/1990 |
| WO | WO2022129238 | A1 | 6/2022 |

OTHER PUBLICATIONS

J. Lee, W. H. Bang, J. P. Jung and K. H. Oh, "Microstructure and Strength of Sn—Bi Coated Sn-3.5 mass% Ag Solder Alloy", Mater Trans, 2004, 45, 783-789.

First Office Action, China National Intellectual Property Administration, Appn # 202380012687.8, Apr. 24, 2025.

Jiang Qiying, "The synthesis of bismuth(III) complexes and the coordination properties of bismuth", Progress in Chemistry, vol. 18, Issue 12, pp. 1634-1645, Dec. 24, 2016.

* cited by examiner

CURRENT (A)
POTENTIAL (V)
12
14
A
C
ADD REAGENT A
B
12A
Z1
ADD REAGENTS A+B
12B
Z2
Z3

CO-ELECTROPLATING Sn—Bi ALLOY SOLDER FOR 3D-IC LOW-TEMPERATURE BONDING

FIELD OF THE INVENTION

This invention relates to electroplating chemical baths, and more particularly for Tin-Bismuth (Sn—Bi) alloy solder co-electroplating.

BACKGROUND OF THE INVENTION

Electronic systems use solders to make electrical connection between components such as Printed Circuit Boards (PCB) and Integrated Circuit (IC) chips. Some traditional solder alloys contain lead (Pb) which can be toxic, so there is interest in lead-free solder alloys.

Many lead-free solder alloys have been used, but these tend to have melting points above 180° C. For example, Tin-Silver-Copper (SnAgCu) solder has a melting point of about 230° C. and a reflow temperature of about 30° C. higher, or 260° C.

Such high melting points are undesirable for certain applications. FIG. 1 shows a 3D or multi-chip stacking device. Chips 102, 104 are IC chips that are stacked on top of each other and to substrate 110, which can be a thicker PCB or other substrate. Solder pads 108 on the top surface of substrate 110 are soldered by solder balls 116 to lower solder pads 118 on the bottom surface of chip 104. Solder pads can have microbumps or other raised areas that provide a desired spacing between chips 102, 104, and substrate 110.

Metal traces, vias, and components on chip 104 connect to upper solder pads 114 on chip 104, which are connected by solder balls 106 to lower solder pads 112 on the bottom of chip 102. Solder balls 106, 116 can have various shapes and can be formed by coating the solder pads with solder paste and reheating to above the melting point of the solder alloy used for solder balls 106, 116.

However, when the solder alloy of solder balls 106, 116 has a high melting point, thermal expansion coefficient mismatch between chips 102, 104 and substrate 110 can cause warping. With convex warpage, substrate 110 bends downward as shown in FIG. 1, causing an increased gap between upper solder pads 108 on substrate 110 and lower solder pads 118 on chip 104. This increased gap can weaken solder balls 116 and cause cracking or other failure of the solder connections. Concave warpage, where chips 102, 104 bend upward at their corners may also occur. Such warpage can occur on 3D multi-chip packages (stacking) when solder reflow temperatures exceed 200° C.

Among the various alloys of Tin, Tin-Bismuth (Sn—Bi) has a lower eutectic temperature of about 139° C. Thus Sn—Bi alloys are desirable for 3D stacked chip systems to reduce warpage.

FIG. 2 is a eutectic phase diagram of Tin-Bismuth (Sn—Bi). The weight percentage of Bismuth in the Tin-Bismuth alloy is plotted on the x-axis while the temperature is plotted on the y-axis. At high temperatures the mixture is a liquid, while at lower temperature the mixture is a solid that can have various structures, such as a Tin-rich solid that occurs below 21% Bismuth.

The melting point of the mixture has a strong dependence on the weight % of Bismuth. Pure Tin has a melting point of 231.9° C., while pure Bismuth has a melting point of 271.4° C. Mixing Tin and Bismuth produces lower melting points, as shown by the upper dashed lines, with a lowest melting point of 139° C. occurring at the eutectic point of 58% Bismuth.

FIG. 3 is a eutectic phase diagram of Tin-Bismuth (Sn—Bi) with a target range. It is desired to limit the melting point of the alloy to 183° C. to prevent warpage when soldering 3D multi-chip packages. The dotted line drawn at 183° C. intersects the upper dashed melting point lines at 29% and 71%. Therefore a mixture of Tin and Bismuth having 29-71% Bismuth by weight would produce an alloy with the melting point below the target 183° C.

Other melting points could be chosen as the target. For example, a mixture of between 35% and 68% by weight of Bismuth in a Tin-Bismuth alloy would have a lower melting point of below 170° C. The closer the mixture is to the eutectic of 58% Bismuth, the lower the melting point and less chance of warpage.

Various techniques could be used with Tin-Bismuth (Sn—Bi) solder alloys. Spot welding or smelting is not suitable for small solder pads such as micro-pillars or micro-structures of less than 100 microns that are common with 3D multi-chip packages. A two-step deposition could be used, where Tin is deposited in a thin layer then Bismuth is deposited over this layer and then reflowed, but this is hard to control and can have an uneven composition of the alloy on the micro-pillars.

Co-deposition can have a shorter deposition time, lower cost, easier handling, and a scalable production, but the large standard electrode potential difference between Tin and Bismuth makes co-deposition difficult.

FIG. 4 is a diagram showing the large standard electrode potential difference between Tin and Bismuth. Cathode current is plotted as a function of voltage. Tin has a standard electrode potential $E_{Sn}$ of −0.137 volt, while Bismuth has a standard electrode potential $E_{Bi}$ of 0.317 volt. Tin ions $Sn^{2+}$ in the bath are deposited on the cathode as Tin atoms Sn when the cathode voltage falls below −0.137 volt. Bismuth ions $Bi^{3+}$ in the bath are deposited on the cathode as Bismuth atoms Bi when the cathode voltage falls below 0.317 volt. Thus, if there are no additives, Bismuth deposition would be predominant.

The standard electrode potential difference between Sn and Bi is 454 mV. This large standard electrode potential difference makes it difficult to co-deposit Sn and Bi in an electrochemical bath, since Bi would plate much more rapidly than Sn, and the deposited alloy would have a very high % of Bi and Sn would be minimal.

Chemical reagents can be added to the electrochemical bath to reduce the standard electrode potential difference between Tin and Bismuth. However, these additives often contain Florine, and such floro compounds tend to be highly toxic. Additives without fluorine have not sufficiently lowered the alloy melting point.

What is desired is co-deposition of Tin and Bismuth to produce a Sn—Bi alloy that has a low melting point. It is desired to have a Sn—Bi alloy that is between about 30% and 70% Bismuth by weight so that the alloy melting point is less than 180° C. An electrochemical bath with chemical reagents that reduce the standard electrode potential difference between Tin and Bismuth is desired. It is further desired to eliminate toxic floro-reagents. Achieving an even, metallic luster of the co-deposited Sn—Bi alloy with a compact and intact microstructure is desired.

DETAILED DESCRIPTION

The present invention relates to an improvement in co-electroplating. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described but is to be accorded the widest scope consistent with the principles and novel features herein disclosed.

Figure 1:
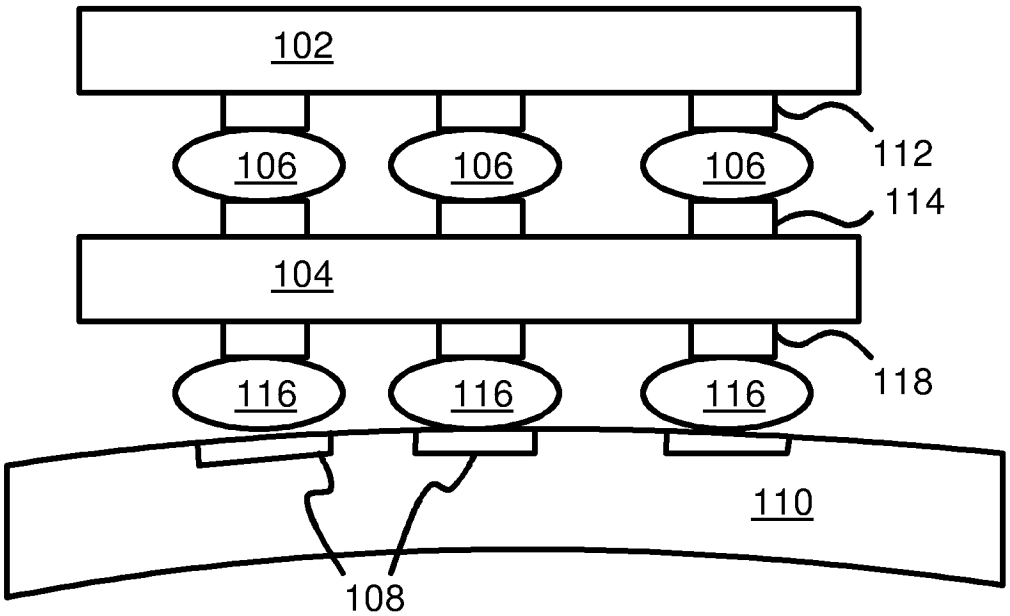
PRIOR ART FIG. 1
FIG. 1 shows a 3D or multi-chip stacking device.
Figure 2:
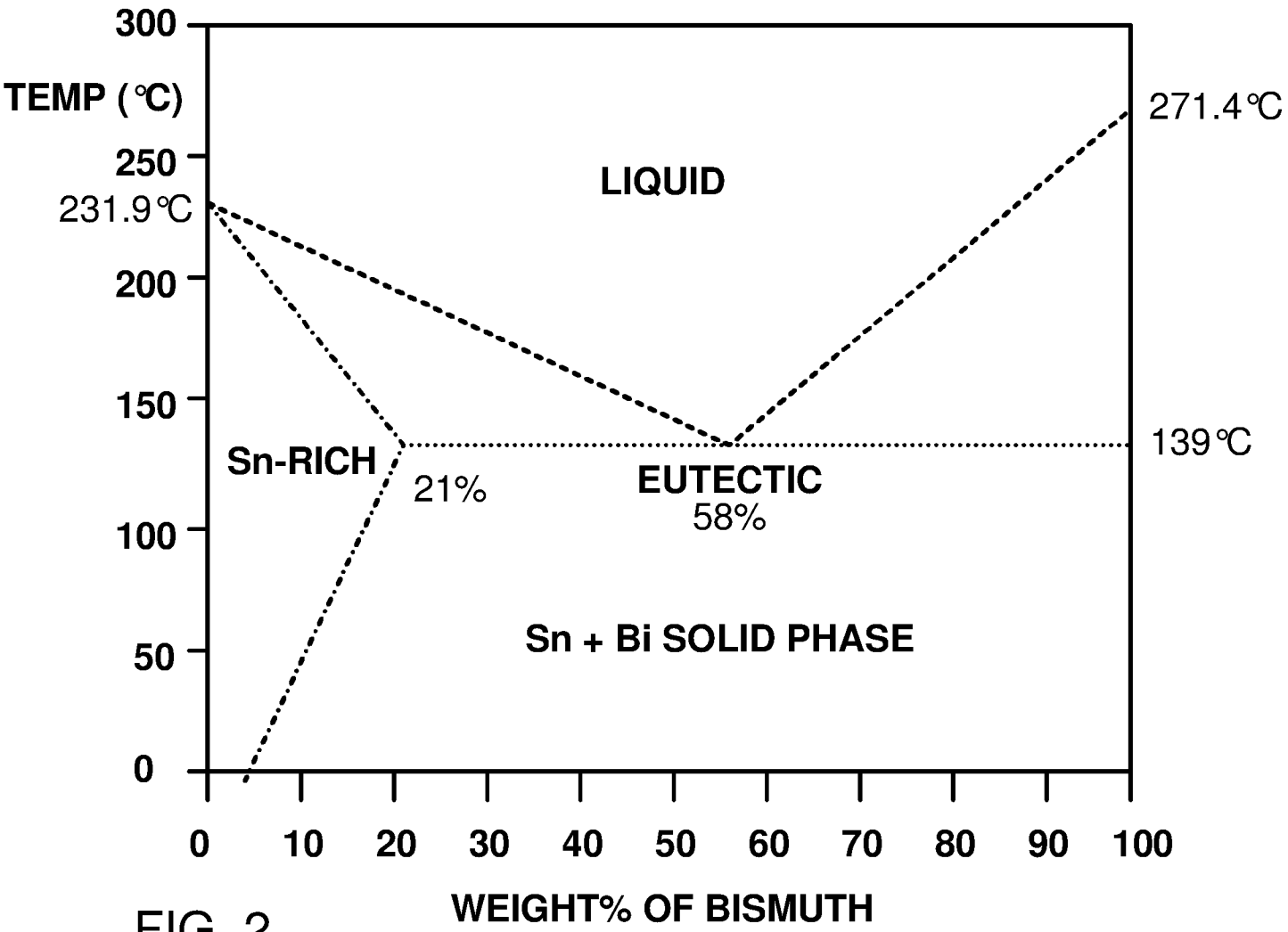
FIG. 2 PRIOR ART
FIG. 2 is a eutectic phase diagram of Tin-Bismuth (Sn—Bi).
Figure 3:
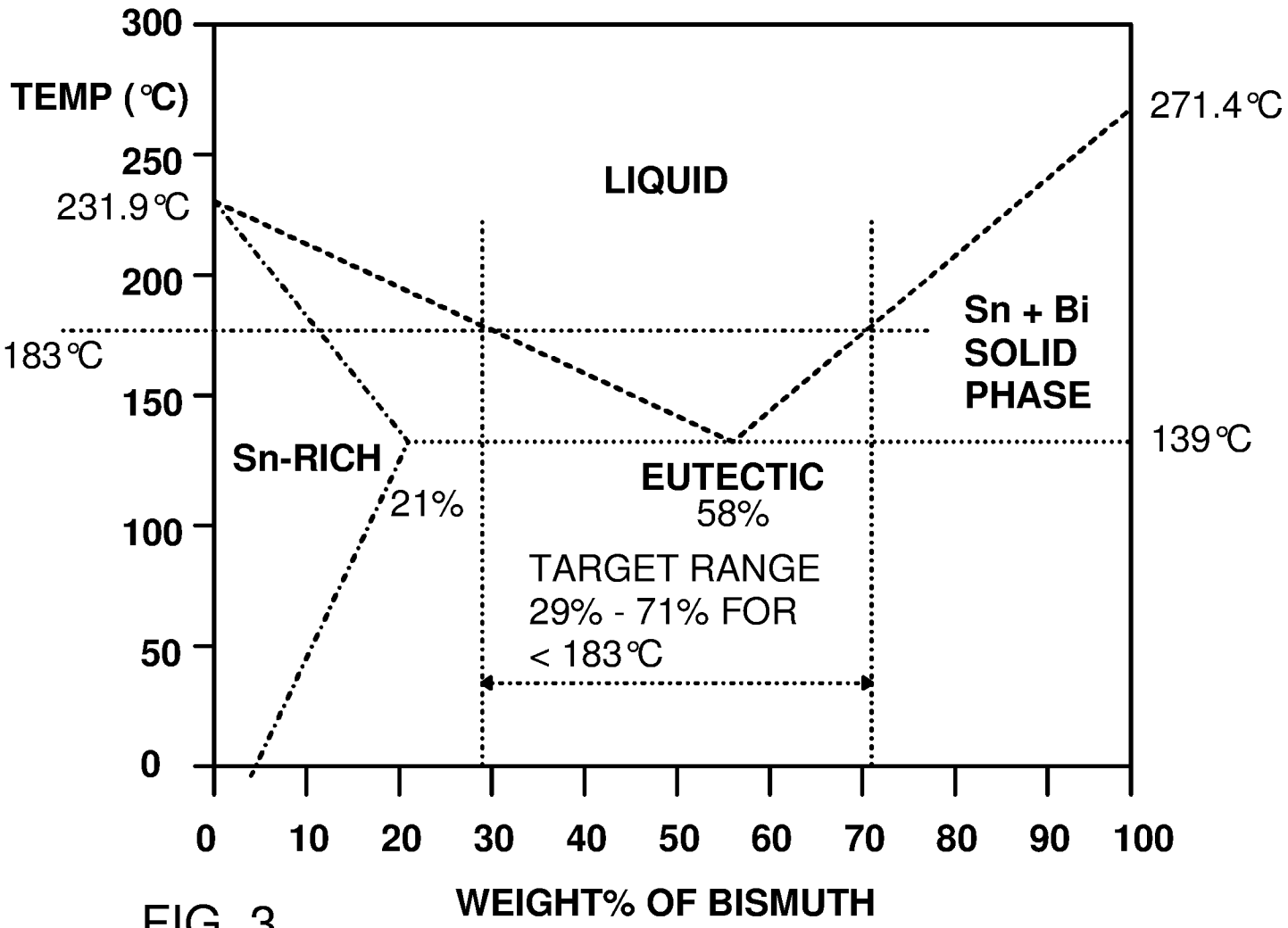
FIG. 3 is a eutectic phase diagram of Tin-Bismuth (Sn—Bi) with a target range.
Figure 4:
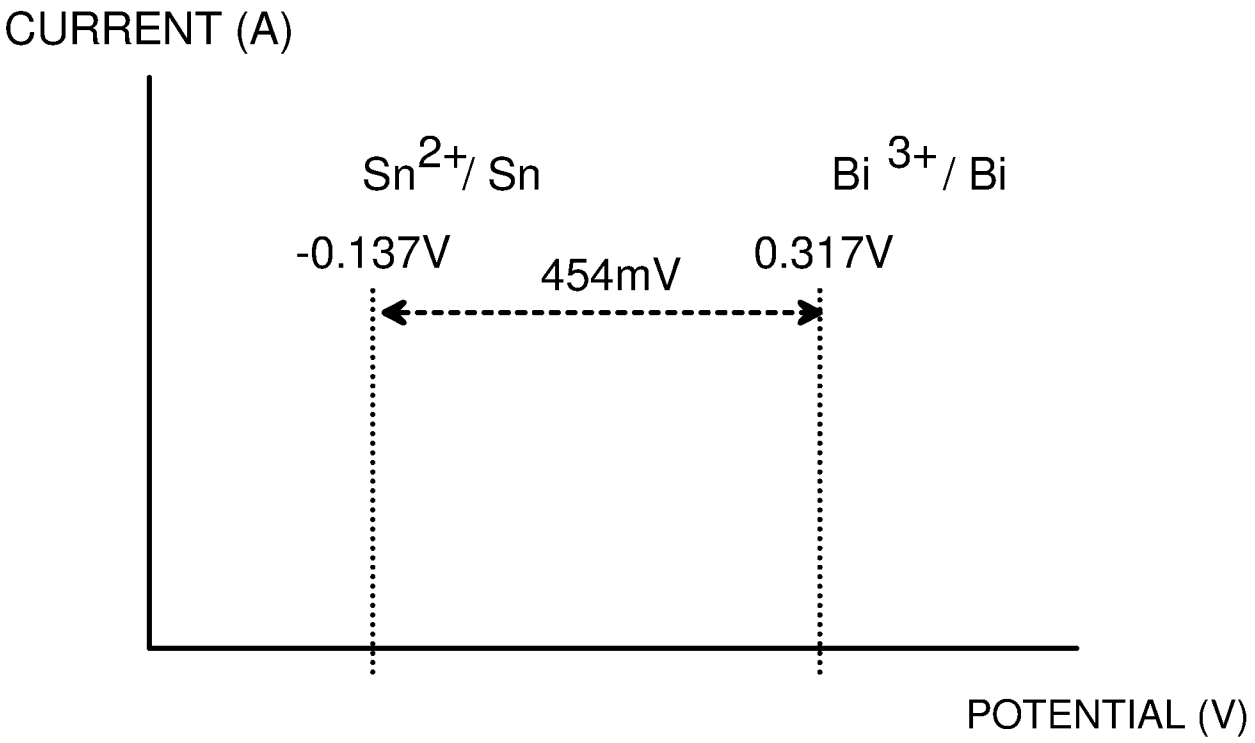
FIG. 4 PRIOR ART
FIG. 4 is a diagram showing the large standard electrode potential difference between Tin and Bismuth.
Figures 5A, 5B, 5C:
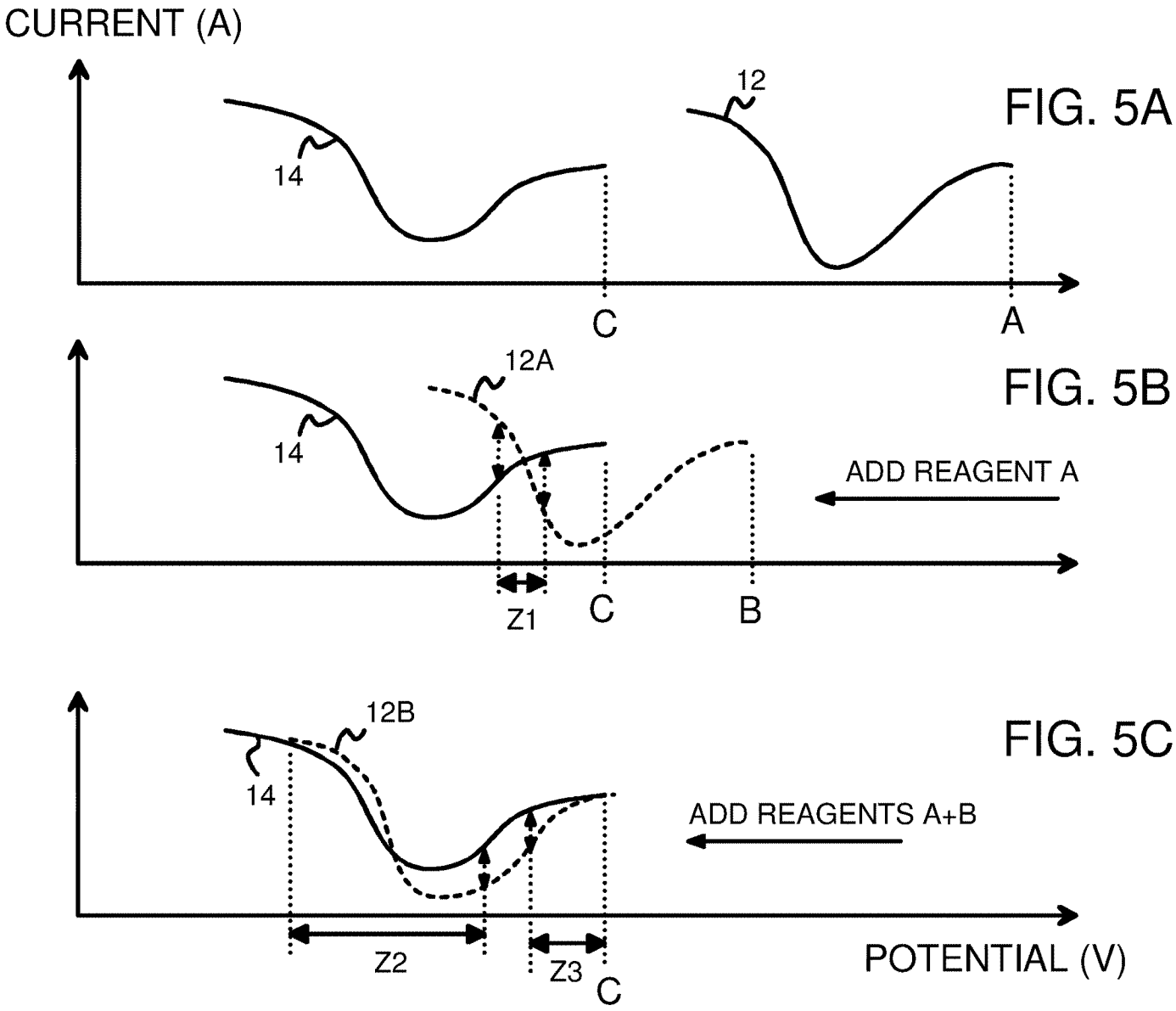
FIGS. 5A-5C highlight reagents reducing the standard electrode potential difference between Tin and Bismuth.

The inventors realize that chemical reagents added to the electrochemical bath can reduce the standard electrode potential difference between Tin and Bismuth. FIGS. 5A-5C highlight reagents reducing the standard electrode potential difference between Tin and Bismuth. In FIG. 5A, Tin curve 14 is the I-V curve for Tin ions being deposited on the cathode, which starts to occur at point C when the cathode potential rises above-0.137 volt. Bismuth curve 12 is the I-V curve for Bismuth ions being deposited on the cathode, which starts to occur at point A when the cathode potential rises above 0.317 volt. The standard electrode potential difference is large when no reagents are added to the electrochemical bath other than the Tin and Bismuth salts.

In FIG. 5B, reagent A is added to the electrochemical bath. Reagent A binds to Bismuth ions to reduce the standard electrode potential of Bismuth so that Bismuth begins plating on the cathode at point B, as shown by shifted Bi curve 12A. Since curves 14, 12A now intersect, there is a window of operation Z1 where co-deposition can occur. The electrode potential difference between Tin (curve 14) and Bismuth (curve 12A) is small enough within window Z1 that both Tin and Bismuth can be deposited together at cathode voltages within window Z1.

However, the steepness of curves 14, 12A near their intersection causes window Z1 to be relatively small, meaning that a small range of voltages can achieve the desired co-deposition.

According to Faraday's law, for $Bi^{3+}$ consuming 3 electrons ($n_{Bi}$=3) and $Sn^{2+}$ consuming 2 electrons ($n_{Sn}$=2), the weight % is Bi is:

$$\frac{MW_{Bi}}{MW_{Bi} + \frac{n_{Bi}}{n_{Sn}} \times \frac{i_{Sn}}{i_{Bi}} \times MW_{Sn}}$$

Where $MW_{Bi}$ is the molecular weight of Bismuth, $MW_{Sn}$ is the molecular weight of Tin, $i_{Sn}$ is the deposition current of Tin, and $i_{Bi}$ is the deposition current of Bismuth.

The ratio of deposition current $i_{Sn}/i_{Bi}$ is limited to a range of 0.5 to 2.74 to achieve the target range of 30-70% by weight Bismuth. Thus current ratio depends on the current (y values) of curves 12B, 14 at each applied voltage (value of x). Thus the calculated ratio of deposition currents limits the range electrode voltages. A wider range of operating conditions and electrode voltages is desirable for better process control.

In FIG. 5C reagent A and reagent B are added to the electrochemical bath. Reagent B and reagent A both bind to Bismuth ions in the electrochemical bath, causing a further lowering of the standard electrode potential of Bismuth, shifting curve 12A of FIG. 5B further to the left, producing curve 12B of FIG. 12C. With the addition of both reagents A and B, both Tin and Bismuth have about the same electrode potential where deposition begins, at point C. Both curves 12, 14 may be shifted due to various mechanisms, such as changes to pH affecting hydrolysis of both Sn and Bi, and other secondary effects. The pH can be between 2.8 and 4.2 with the addition of reagent B, and the further addition of acid reagent A can lower the pH to below 1.

Curves 14, 12B intersect at starting point C, and co-deposition can occur over a voltage range of window Z3. Also, curves 14, 12B intersect at a larger (more negative) voltage within window Z2. Electroplating of Sn—Bi can occur in either window Z2 or window Z3, with a relatively wide voltage range in each window allowing for a stable and controllable process.

Figure 6:
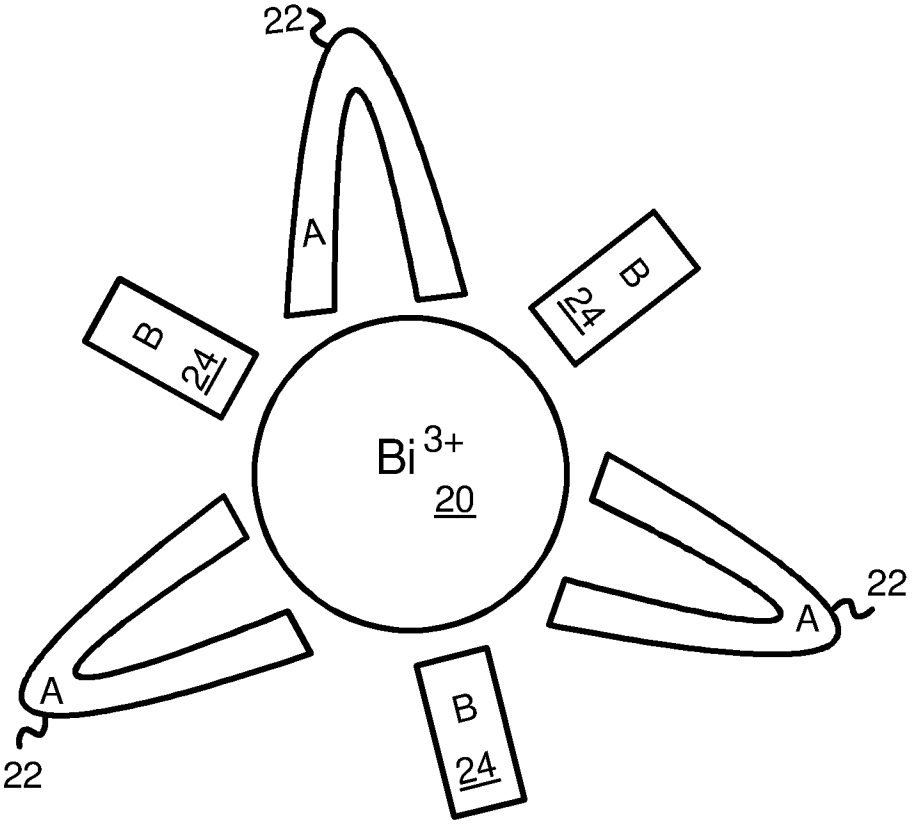
FIG. 6 shows reagents A and B binding to a Bismuth ion in an aqueous electrochemical bath.

FIG. 6 shows reagents A and B binding to a Bismuth ion in an aqueous electrochemical bath. A Bismuth salt such as $Bi_2(SO_4)_3$, $BiCl_3$, $Bi(NO_3)_3$ or $Bi(MSA)_3$, is added to a water bath along with a Tin salt such as sulfonic, chloride, nitric or Methyl sulfonic Tin along with reagents A and B. The pH of the electrolyte bath can be controlled to be acidic to prevent hydrolysis of Tin and Bismuth ions.

Reagent A is a relatively larger acid molecule, such as a nitric, sulfuric, carboxylic, sulfonic, or phenyl acid. Reagent A inhibits the hydrolysis of the metal M ions $Bi^{3+}$ and $Sn^{2+}$ such as in the reaction $Mn^{n+}$+n $H_2O \rightarrow M(OH)_n$+n H+ when n is a whole number. Reagent A also selectively forms a complex with $Bi^{3+}$ ions. FIG. 6 shows $Bi^{3+}$ ion 20 that has three reagent A molecules 22 attached. Reagent A molecules 22 are relatively large, so a limited number of reagent A molecules 22 can attach to any one $Bi^{3+}$ ion 20.

In contrast with reagent A, reagent B is a small molecule, such as an imine, ketone, aldehyde, or thiophene. Since reagent B molecule 24 is relatively small, it can attach to $Bi^{3+}$ ion 20 in between reagent A molecules 22, in spaces that are too small for another reagent A molecule 22 to attach to $Bi^{3+}$ ion 20.

The chelate or ion complex formed with reagent A molecules 22 and reagent B molecule 24 attached to $Bi^{3+}$ ion 20 is more stable than $Bi^{3+}$ ion 20 in water. The chelating increases the activation energy required to release $Bi^{3+}$ ions 20 from the complex, slowing the Bi deposition rate at the electrode.

$Bi^{3+}$ has a higher valency and has a larger ionic radius than $Sn^{2+}$, so $Bi^{3+}$ will more readily form a complex with reagent A molecules 22 and reagent B molecules 24 than will $Sn^{2+}$ Thus the addition of reagents A and B will preferentially attach to $Bi^{3+}$ and not to $Sn^{2+}$. Instead $Sn^{2+}$ will tend to form complexes with water.

The complexes with Bismuth reduce the electrode potential of Bi from its standard electrode potential, reducing the standard electrode potential difference between Sn and Bi. Since $Bi^{3+}$ ions have a larger valency and ionic radius, they more readily form complexes compared to $Sn^{2+}$ ions.

Figure 7:
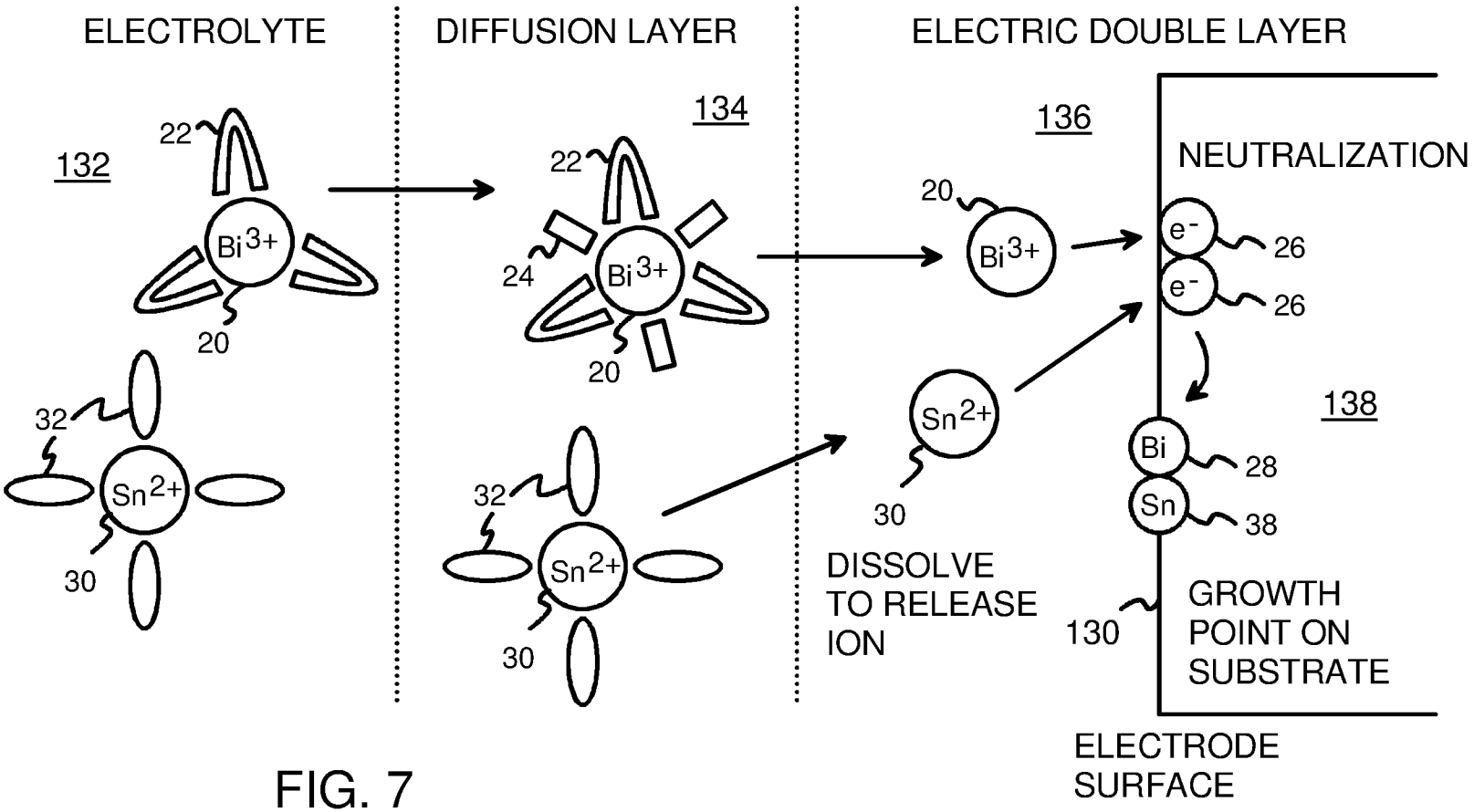
FIG. 7 highlights co-deposition of Sn and Bi in an electrolyte bath with reagents A and B chelating with Bismuth ions.

FIG. 7 highlights co-deposition of Sn and Bi in an electrolyte bath with reagents A and B chelating with Bismuth ions. Electrolyte bath 132 has $Bi^{3+}$ and $Sn^{2+}$ ions that are released from salts. Water molecules 32 attach to $Sn^{2+}$ ions 30 in the aqueous solution while reagent A molecules 22 and reagent B molecules 24 attach to $Bi^{3+}$ ions 20. Reagent A molecules 22 may first lose a proton before attaching to $Bi^{3+}$ ions 20.

At equilibrium, the complex of reagent A molecules 22 and reagent B molecule 24 with $Bi^{3+}$ ions 20 continuously releases $Bi^{3+}$ ions 20 and re-forms the complex. In electric double layer 136 in the aqueous solution near surface 130 of cathode 138, these released $Bi^{3+}$ ions 20 and $Sn^{2+}$ ions 30 are attracted to the excess of electrons 26 on surface 130 of cathode 138 and are neutralized by electrons 26 at surface 130 to form electroplated Bismuth atoms 28 and electroplated Tin atoms 38. A negative power supply terminal that is electrically attached to cathode 138 supplies additional electrons 26 as neutralization and deposition consume electrons 26.

As $Bi^{3+}$ ions 20 are deposited on cathode 138, a lower density of $Bi^{3+}$ ions 20 is created in electric double layer 136. This lower ion density causes complexes of $Bi^{3+}$ ions 20 with reagent A molecules 22 and reagent B molecule 24 attached to diffuse toward cathode 138 through diffusion layer 134. Similarly, a lower concentration of $Sn^{2+}$ ions 30 in electric double layer 136 causes diffusion of $Sn^{2+}$ ions 30 from electrolyte bath 132 through diffusion layer 134 to equalize concentrations.

Figure 8:
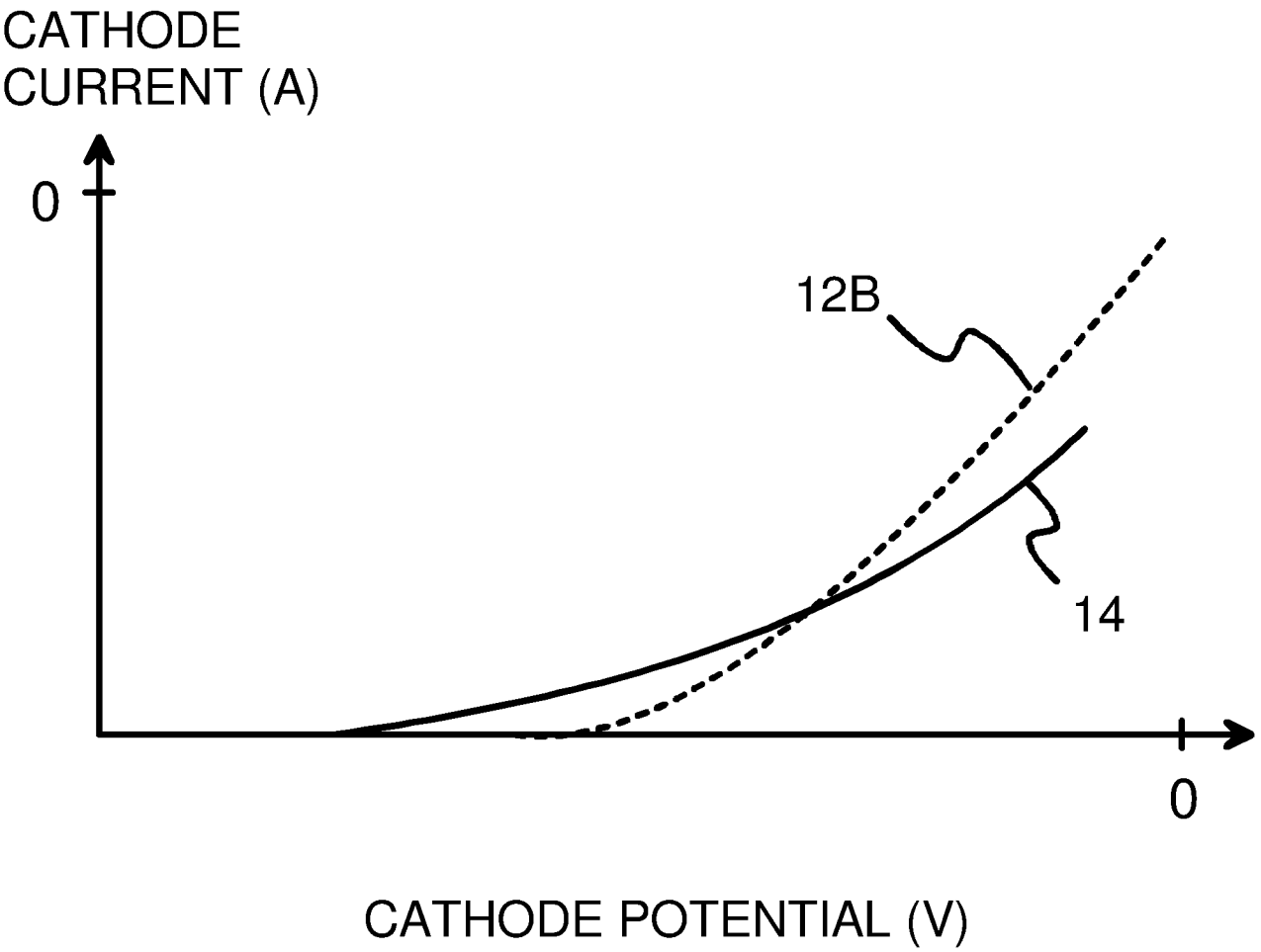
FIG. 8 is an I-V diagram of cathode co-deposition of Sn and Bi when reagents A and B reduce the standard electrode potential difference.

FIG. 8 is an I-V diagram of cathode co-deposition of Sn and Bi when reagents A and B reduce the standard electrode potential difference. Reagents A and B bind with $Bi^{3+}$ ions 20 to shift its I-V curve (FIG. 5B) so that the standard electrode potential of Sn ($E_{Sn}$) and Bi ($E_{Bi}$) are close together. Curve 14 shows that as the voltage increases, the current of electrons needed to neutralize $Sn^{2+}$ ions 30 and the deposition rate of electroplated Tin atoms 38 increases. Curve 12B similarly shows that as the voltage increases, the current of electrons needed to neutralize $Bi^{3+}$ ions 20 and the deposition rate of electroplated Bismuth atoms 28 increases.

Since curves 12B, 14 are close to each other and even intersect, the difference in electron current for Bi and Sn deposition is small, allowing for a wider operating window. At the intersection of curves 12B, 14, the electrical currents of Bi and Sn are equal, and accounting for the charge difference ($Bi^{3+}$ and $Sn^{2+}$) a weight % of Bi in the deposited alloy can be 54%.

The relative concentrations of $Bi^{3+}$ ions 20 and $Sn^{2+}$ ions 30 can be adjusted by varying the concentrations of their salts added to electrolyte bath 132, and the electron current can be controlled to limit the deposition rates.

With the addition of reagents A and B, the relative concentrations of $Bi^{3+}$ ions 20 and $Sn^{2+}$ ions 30 can be close to 1:2, allowing about two electroplated Tin atoms 38 to be deposited for every electroplated Bismuth atom 28. The actual situation depends on the ability of the complexant/chelators that have a different number of ligands in one molecule. The concentration of Bismuth could be much larger than that of Tin if the Bismuth complex formed is very stable. A target mixture such as 54% by weight Bismuth can be deposited by adjusting concentrations to account for the atomic weight difference of Bismuth (atomic number 83, weight 209) and Tin (atomic number 50, weight 118.7). The concentration of Bismuth can be roughly double (209/118.7) that of Tin.

Thus the deposited alloy on the cathode can be close to the eutectic that is 57% by weight Bismuth. Process variations can be tolerated when a wider range such as 30% to 70% is acceptable.

Figure 9:
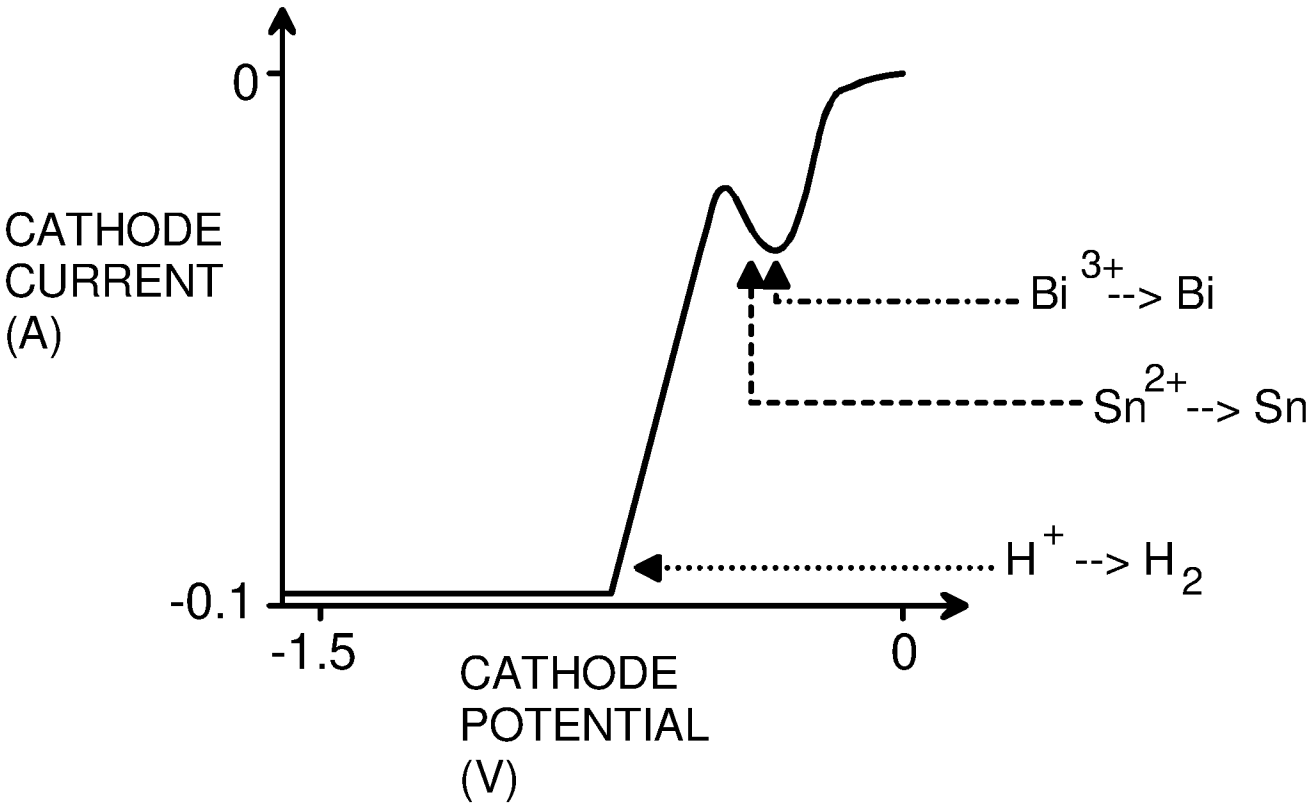
FIG. 9 is a Linear Sweep Voltammetry (LSV) diagram of co-deposition of Sn and Bi when reagents A and B reduce their standard electrode potential difference.

FIG. 9 is a Linear Sweep Voltammetry (LSV) diagram of co-deposition of Sn and Bi when reagents A and B reduce their standard electrode potential difference. As the cathode voltage is decreased from 0, the origin in the upper right corner of the graph, the LSV curve of FIG. 9 is generated. Current decreases (negative current increases) from near-zero when the standard electrode potential of the hydrogen ion to hydrogen gas reaction is reached, where $H^+$ ions in the aqueous solution are converted to $H_2$ hydrogen gas at the cathode surface. Current continues to decrease until a dip is reached when the current increases as voltage decreases. After the dip current again decreases with voltage.

This dip occurs when the cathode voltage reaches the standard electrode potential of the Tin deposition reaction, where $Sn^{2+}$ ions 30 combine with electrons 26 to produce electroplated Tin atoms 38. Reagents A and B cause the standard electrode potential of Tin to be about the same as that of Bismuth, wherein $Bi^{3+}$ ions 20 combine with electrons 26 to deposit electroplated Bismuth atoms 28. Since the standard electrode potential difference is small, deposition of Tin atoms occurs at about the same voltage that deposition of Bismuth atoms occurs, so only a single (overlapping) dip is observed, rather than two dips, one for Sn and one for Bi.

$H_2$ Gas Might Shadow Surface to Cause Alloy Irregularities

Figure 10B:
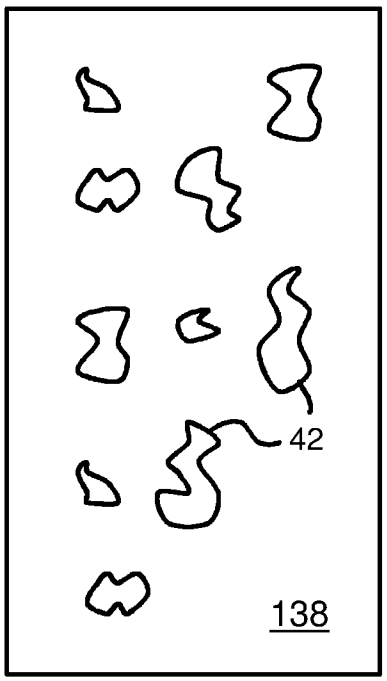
PRIOR ART FIG. 10B
FIGS. 10A-10B highlight the problem of hydrogen gas generation at the cathode.
Figure 10A:
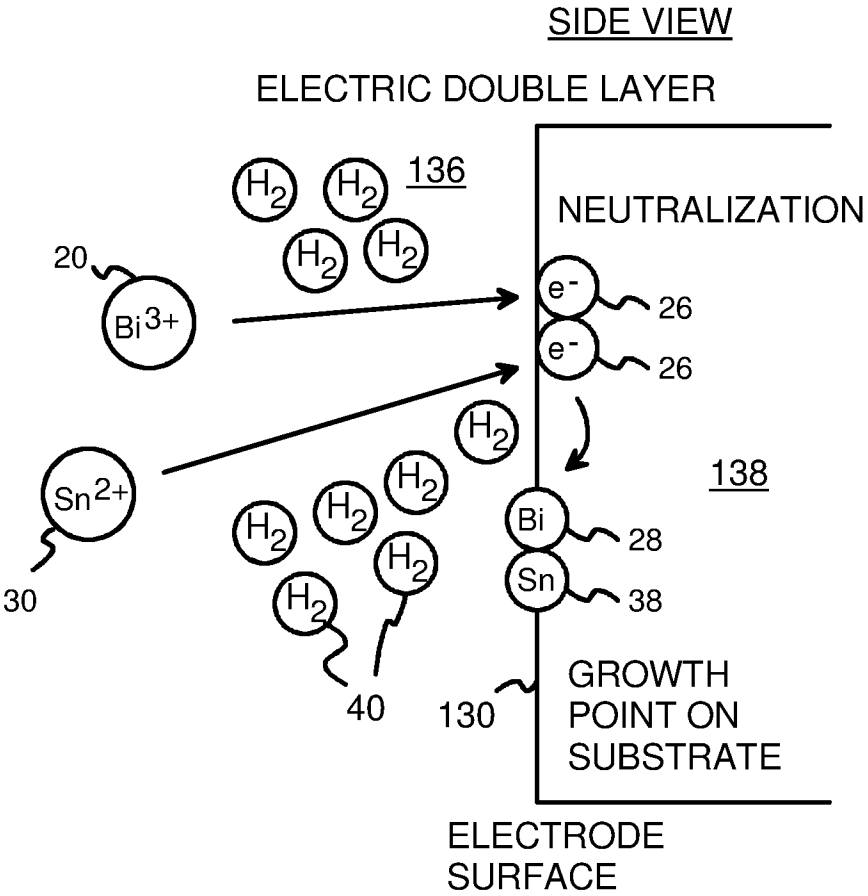
PRIOR ART FIG. 10A

FIGS. 10A-10B highlight the problem of hydrogen gas generation at the cathode. In FIG. 10A, the aqueous solution near surface 130 of cathode 138 has an excess of electrons 26 that attract $Bi^{3+}$ ions 20 that are neutralized to deposit electroplated Bismuth atoms 28 and that attract $Sn^{2+}$ ions 30 that are neutralized to deposit electroplated Tin atoms 38.

However, FIG. 9 shows that the standard electrode potential for hydrogen is higher than that for Tin and Bismuth. Thus hydrogen ions (protons) $H^+$ in the aqueous solution in electric double layer 136 are also attracted to electrons 26 on surface 130 and are converted to hydrogen gas (2 $H^+$+2$e^-$ $\rightarrow H_2$). This side reaction to produce hydrogen gas is common in an acidic electrolytic solution. The standard potential of proton to hydrogen gas is 0 V. There is a large overpotential of hydrogen generation in the practical deposition, which makes the potential move negatively to prevent the generation of hydrogen gas. However, in the highly acidic solvent, the potential of hydrogen gas generation would shift positively, making it much more readily generated.

The inventors have observed this hydrogen gas forming at the cathode surface. In particular, hydrogen gas production seems to be more serious for Sn—Bi co-deposition than for simple copper deposition, although this has not been studied in detail. Although reagents A and B reduce hydrogen gas generation at surface 130, hydrogen gas was still observed in experiments to be generated and gathered at surface 130.

The inventors have also observed loose and non-uniform films of co-deposited Sn—Bi alloys even when reagents A and B are used. FIG. 10B shows a top view of cathode 138 after a Sn—Bi film was co-deposited from an electrolyte bath with reagents A and B. Although a near-eutectic composition of 54% by weight Bismuth is deposited onto surface 130 of cathode 138, a close examination reveals irregularities 42. These irregularities 42 can appear to be loose, porous, flaky, and lack metallic luster that is desirable in a uniform metallic film. These irregularities 42 can be caused by the tip effect, wherein tips once formed on surface 130 have a higher current density of electrons 26 and thus attract and deposit more Sn and Bi than lower or flatter areas on surface 130. Irregularities 42 might also be caused by the different crystalline structures of Sn and Bi, which are difficult to deposit together due to their different locations in the periodic table.

The inventors theorize that this hydrogen gas generation causes $H_2$ gas molecules 40 near surface 130. Rather than be dispersed evenly, $H_2$ gas molecules 40 may gather together and form groups or clumps that block $Bi^{3+}$ ions 20 and $Sn^{2+}$ ions 30 from reaching surface 130. Localized groups of $H_2$ gas molecules 40 may block access of an area on surface 130, causing $Bi^{3+}$ ions 20 and $Sn^{2+}$ ions 30 to be deposited on other areas of surface 130 that are not blocked by a group of $H_2$ gas molecules 40. Thus groups of $H_2$ gas molecules 40 can cast shadows onto surface 130 that have a lower growth of electroplated Bismuth atoms 28 and electroplated Tin atoms 38. This uneven growth caused by shadowing of surface 130 by $H_2$ gas molecules 40 can result in irregularities 42.

Inventors Add Reagent C to Sweep $H_2$ from Cathode Surface

Figure 11:
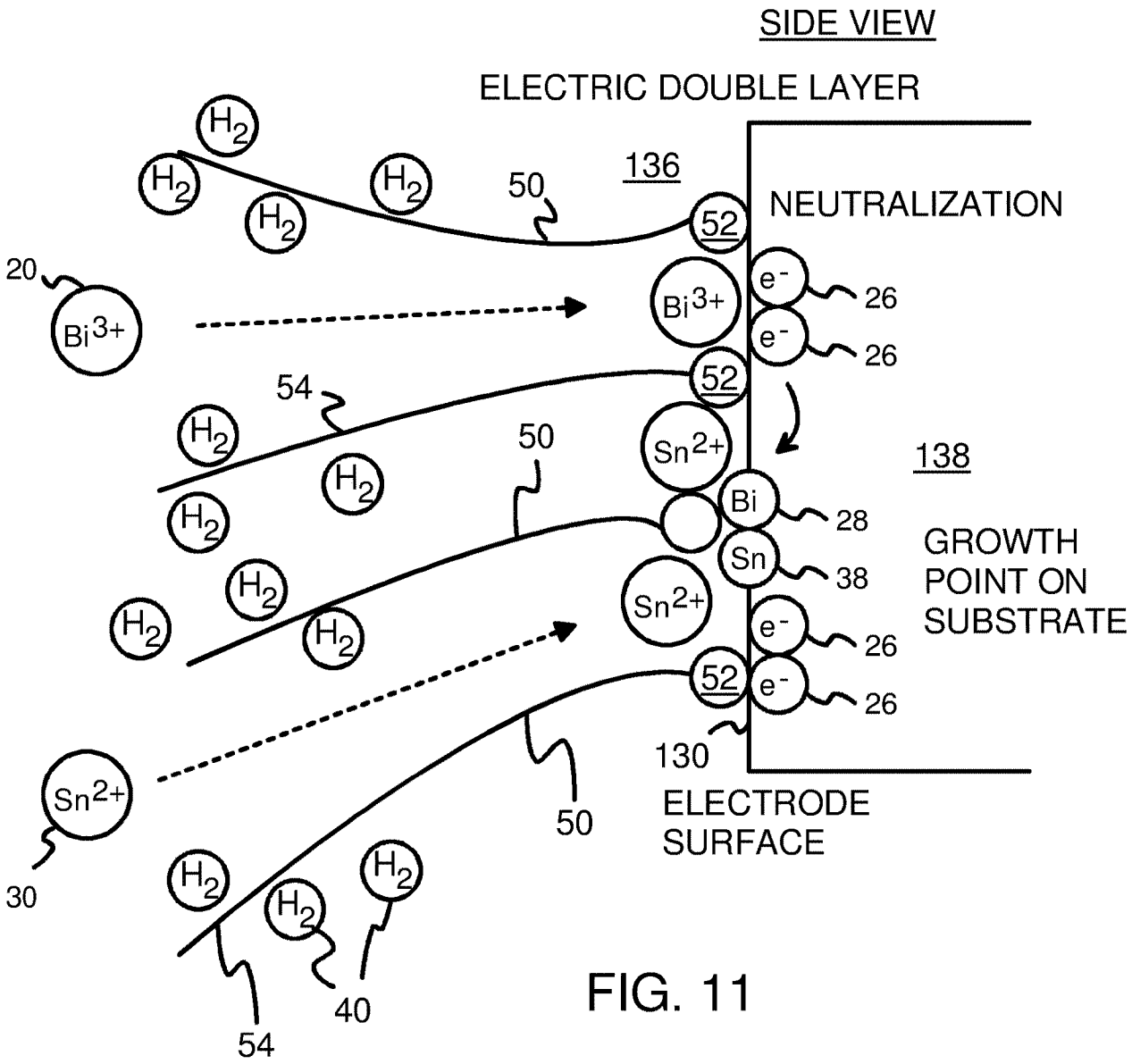
FIG. 11 highlights using reagent C to sweep $H_2$ gas away from the cathode surface to reduce deposited alloy film irregularities.

FIG. 11 highlights using reagent C to sweep $H_2$ gas away from the cathode surface to reduce deposited alloy film irregularities. The inventors add a third reagent C to the electrolyte bath. This reagent C is a surfactant that has hydrophilic end 52 that is attracted to electrons 26 and attaches to surface 130. Reagent C molecule 50 also has a hydrophobic tail 54 that can be a long aliphatic chain that attracts $H_2$ gas molecules 40. The length of hydrophobic tail 54 can be long enough so that $H_2$ gas molecules 40 are removed from near surface 130, allowing $Bi^{3+}$ ions 20 and $Sn^{2+}$ ions 30 to reach surface 130 for deposition. For example, the length of hydrophobic tail 54 can be several times greater than the diameter of $Bi^{3+}$ ions 20.

Hydrophobic tail 54 may contain only carbon and hydrogen atoms, and thus is not polar and attracts other non-polar molecules such as $H_2$ gas molecules 40 using charge fluctuations such as Van der Waals forces.

Hydrophilic end 52 contains one or more heteroatoms that are polar and are thus attracted to the negative charge of electrons 26. $Bi^{3+}$ ions 20 and $Sn^{2+}$ ions 30 are polar and are thus also attracted to hydrophilic end 52 due to the principle of similar solubility. $Bi^{3+}$ ions 20 and $Sn^{2+}$ ions 30 will be more strongly attracted to electrons 26 once they are near surface 130 so reagent C molecule 50 will not permanently bind to $Bi^{3+}$ ions 20 or $Sn^{2+}$ ions 30 and prevent deposition.

Thus reagent C molecule 50 not only sweeps $H_2$ gas molecules 40 away from surface 130 but also attracts $Bi^{3+}$ ions 20 and $Sn^{2+}$ ions 30 to surface 130. Once $H_2$ gas molecules 40 are attracted to hydrophobic tail 54, $H_2$ gas molecules 40 can be released into electrolyte bath 132 and diffuse away. Hydrogen gas eventually bubbles out of electrolyte bath 132 and can be removed by ventilation equipment. Buildup of hydrogen gas can be dangerous so sufficient ventilation above electrolyte bath 132 should be provided.

Figure 12:
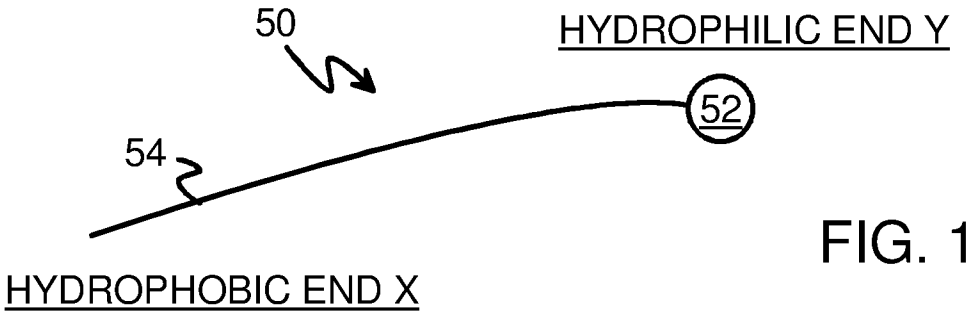
FIG. 12 shows a reagent C molecule.

FIG. 12 shows a reagent C molecule. Reagent C molecule 50 has hydrophilic end 52 that is polar and attached to the cathode surface, and hydrophobic tail 54 that extends away from the cathode surface.

Figure 13:
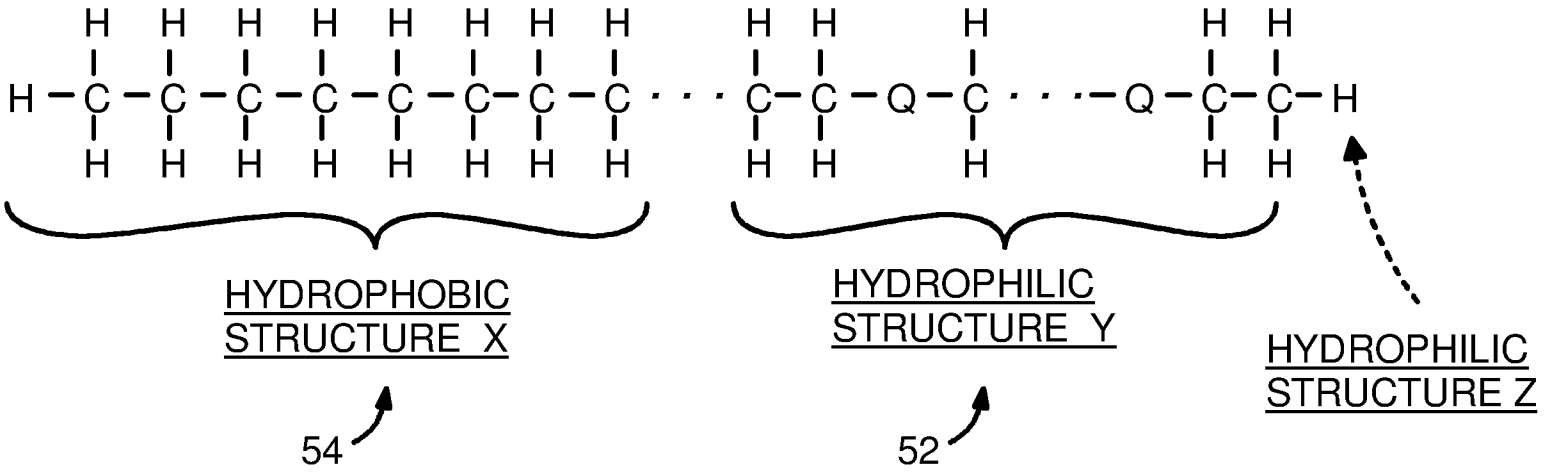
FIG. 13 shows the structure of reagent C molecule in more detail.

FIG. 13 shows the structure of reagent C molecule in more detail. Hydrophobic tail 54 has only carbon (C) and hydrogen (H) atoms and is thus aliphatic. Hydrophobic tail 54 can be an aliphatic chain as shown, or can have branches, rings, or various other structures X. The combination of only C and H makes structure X, hydrophobic tail 54, hydrophobic.

Hydrophilic end 52 has one or more heteroatoms, which are atoms that are not carbon or hydrogen. Heteroatoms can form a bond with water and are thus hydrophilic. These heteroatoms are shown as atoms Q in hydrophilic end 52, also referred to as structure Y.

The last carbon in hydrophilic end 52 is bonded to a hydrogen atom, which is referred to as structure Z. When Z is hydrogen, or a larger aliphatic structure, then it is hydrophobic, but if this structure Z contains a heteroatom, then Z is hydrophilic. When Z is aliphatic, it forms a second hydrophobic tail.

Many variations of structures X, Y, and Z are possible beyond the simple example shown in FIG. 13.

Figure 14:
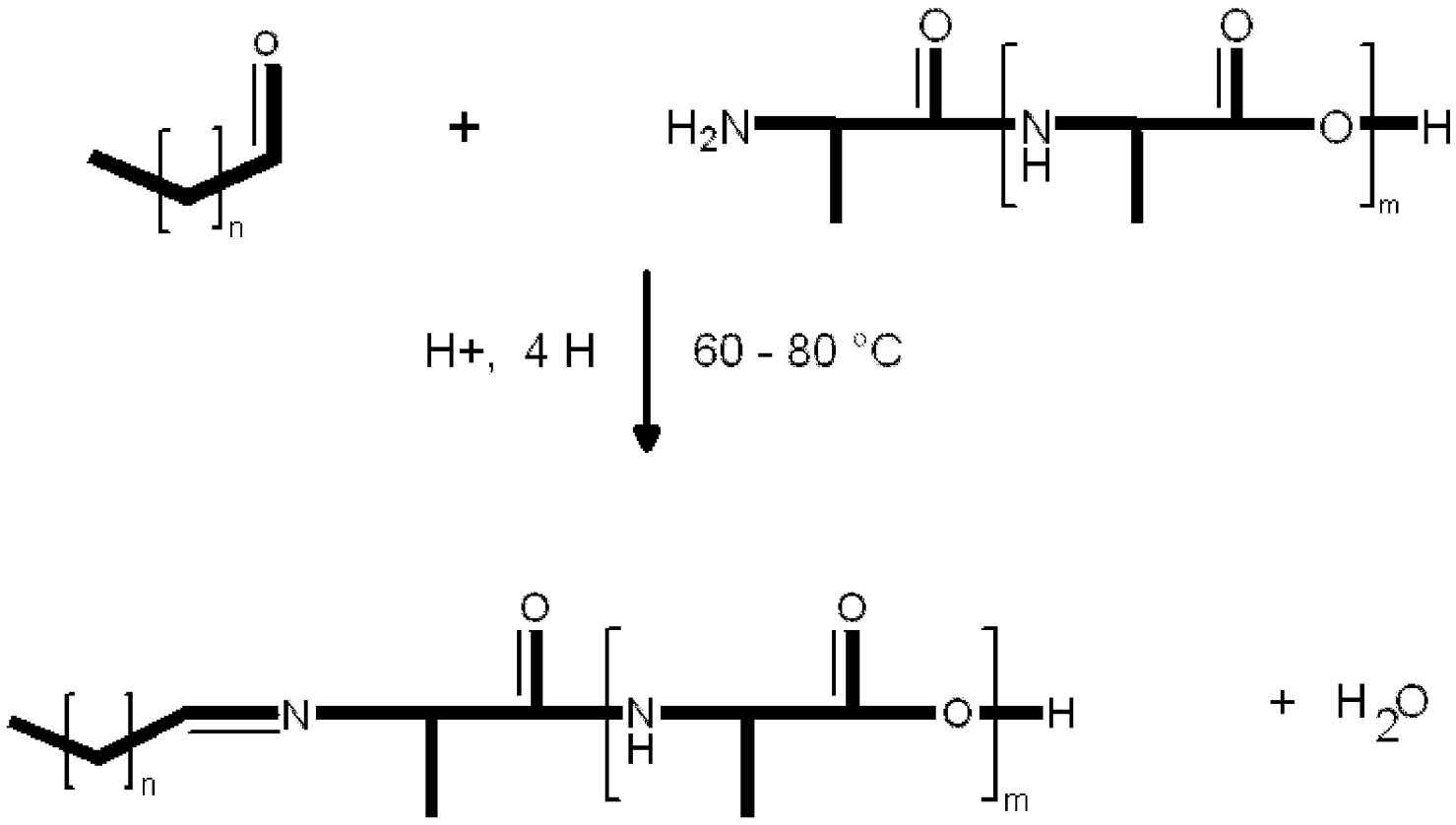
FIG. 14 shows a first example of a condensation reaction to synthesize the reagent C molecule.

FIG. 14 shows a first example of a condensation reaction to synthesize the reagent C molecule. This is a condensation reaction of an aliphatic aldehyde and an ammonium group to generate an imine group. The ammonium group is from a structure of a polypeptide.

The aliphatic aldehyde of the first reactant forms the aliphatic chain of structure X, hydrophobic tail 54, after the C=O group of the aldehyde reacts with the $NH_2$ group of the second reactant to link together the two reactant molecules. The heteroatoms nitrogen (N) and oxygen (O) in the second reactant are hydrophilic, so the second reactant forms hydrophilic end 52 in the product molecule.

The aliphatic chain length n can be larger than the repeating group count m, so that hydrophobic tail 54 is much longer than hydrophilic end 52. In another example, m=20 and n=8. In some variations m can be 0.

Figure 15:
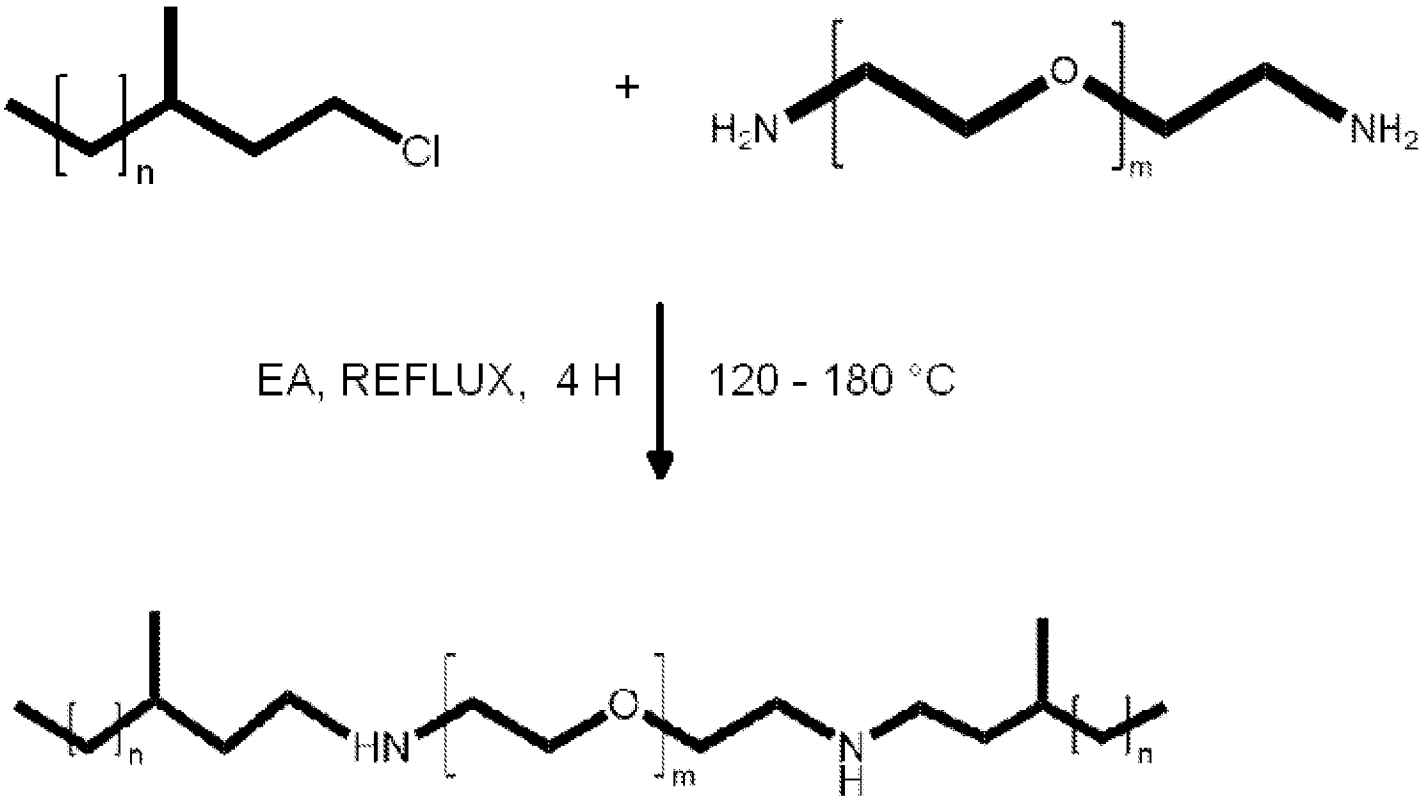
FIG. 15 shows a second example of a reaction to synthesize the reagent C molecule.

FIG. 15 shows a second example of a reaction to synthesize the reagent C molecule. The first reagent is a chlorinated hydrocarbon with a side branch between the long aliphatic chain and the chlorine end. The second reagent is a polymer with two amine ends. Since there are two amine ends of the second reagent, two first reagent molecules attach to one second reagent molecule. The oxygen in the polymer is hydrophilic, so hydrophilic end 52 is sandwiched between two hydrophobic tails 54 in the product molecule.

The synthesis can be carried out in an acidic reflux reaction with Ethyl Acetate (EA) at a temperature of 120~180° C. Two chlorinated hydrocarbon molecules attach to one second reagent molecule. The second reagent molecule is a polymer, $NH_2$-PEG-$NH_2$ (Amine-PEG1000-Amine), where PEG is a polyethylene glycol.

Figure 16:
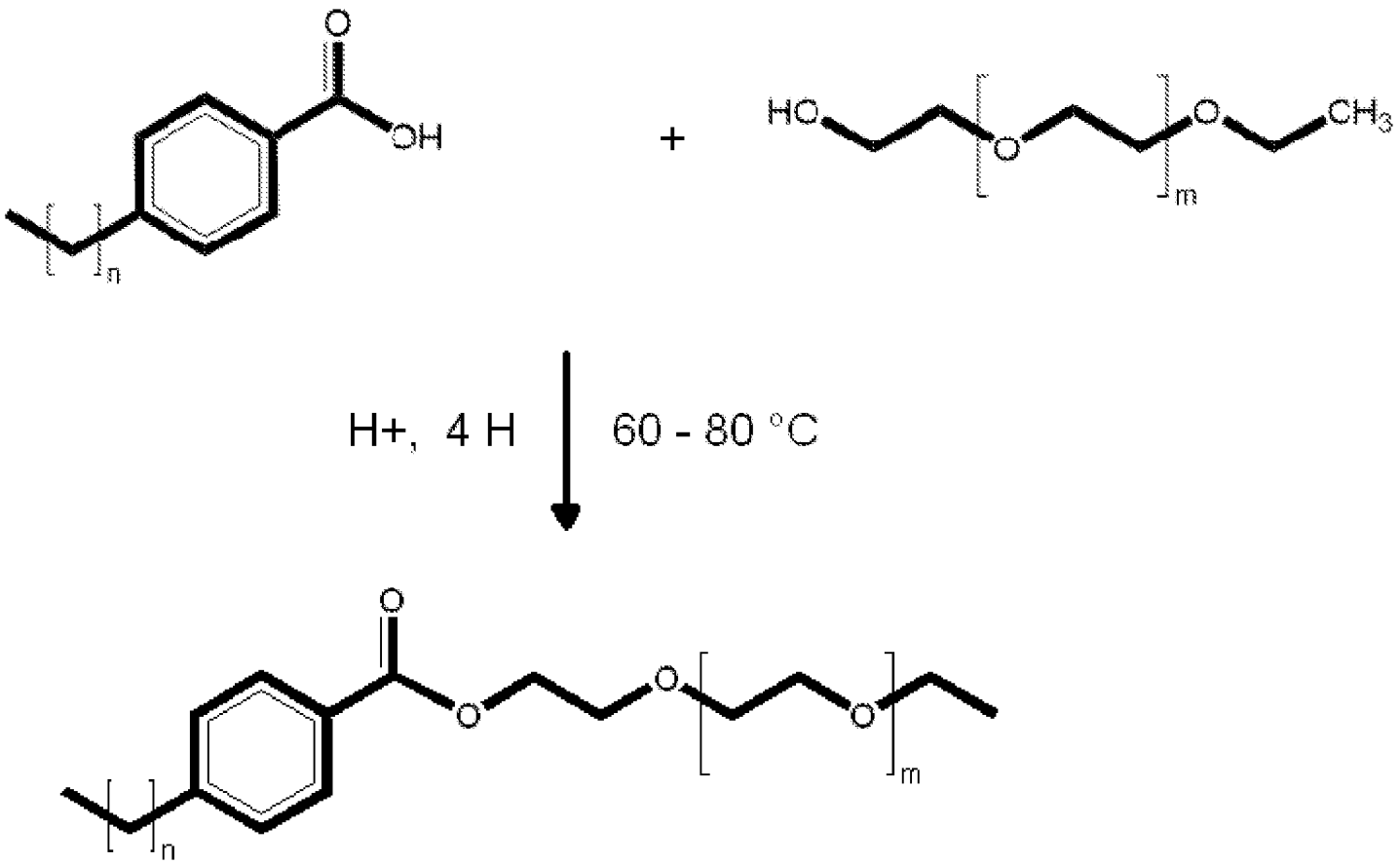
FIG. 16 shows a third example of an esterification reaction to synthesize the reagent C molecule.

FIG. 16 shows a third example of an esterification reaction to synthesize the reagent C molecule. The first reagent is an alkylbenzoic acid that forms the aliphatic chain and the aromatic ring of hydrophobic tail 54. The second reagent is a polyethylene glycol (PEG). The oxygen heteroatoms in the second reagent cause the second reagent to become hydrophilic end 52 in the product ester, another example of reagent C molecule 50.

Figure 17:
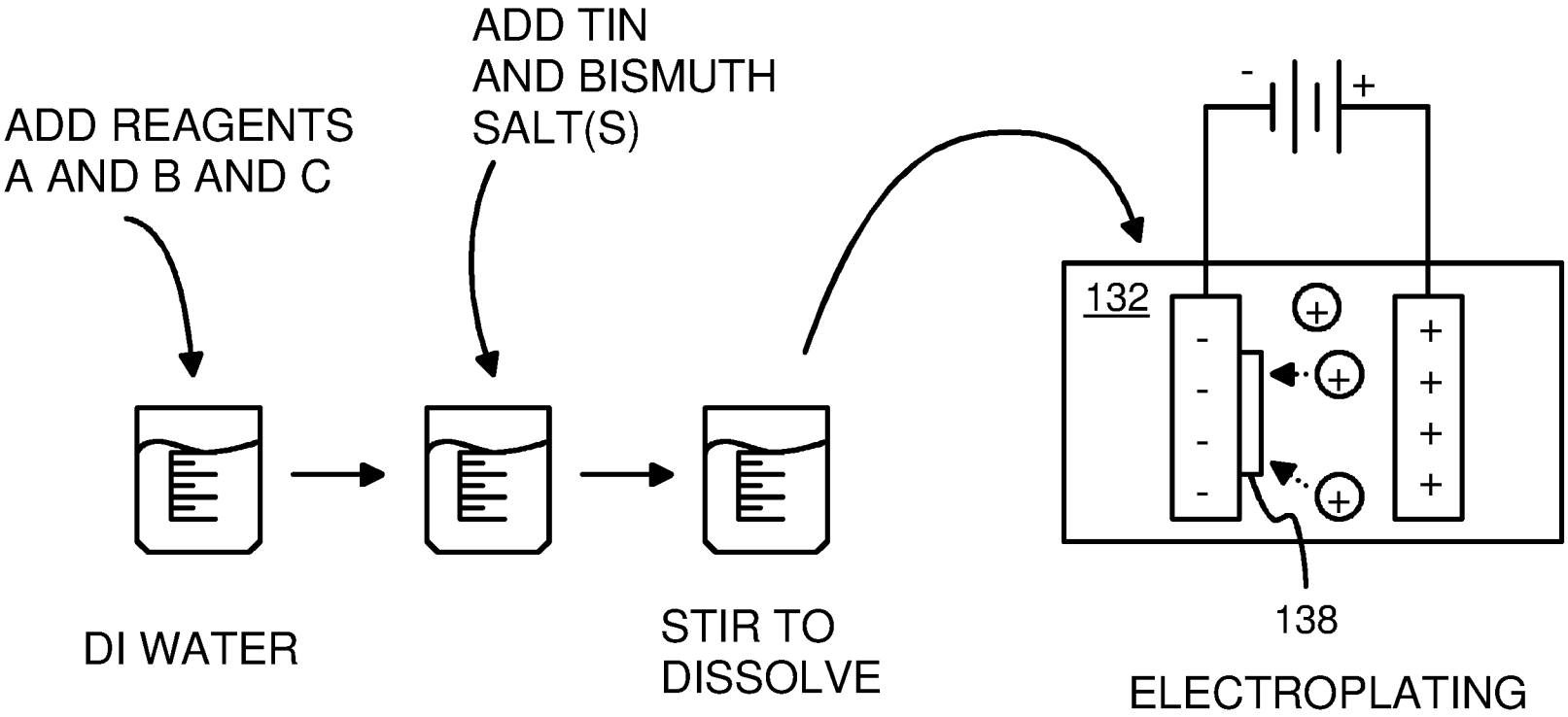
FIG. 17 shows preparation of the electrolyte bath for co-deposition of Sn and Bi.

FIG. 17 shows preparation of the electrolyte bath for co-deposition of Sn and Bi. Reagents A, B, and C are added to deionized water (DI). The Tin and Bismuth salts are also added to reach the desired concentrations for the operating window. The salts are stirred until dissolved, allowing $Sn^{2+}$ ions 30 to bind with water and $Bi^{3+}$ ions 20 to bind with reagent A molecules 22 and reagent B molecules 24.

The water with the dissolved salts and reagents can be added to a tank for electrolyte bath 132. The device to be electroplated, such as chips 102, 104, are attached to cathode 138, which is then connected to the negative power supply to commence electroplating and co-deposition of Sn and Bi.

Figure 18:
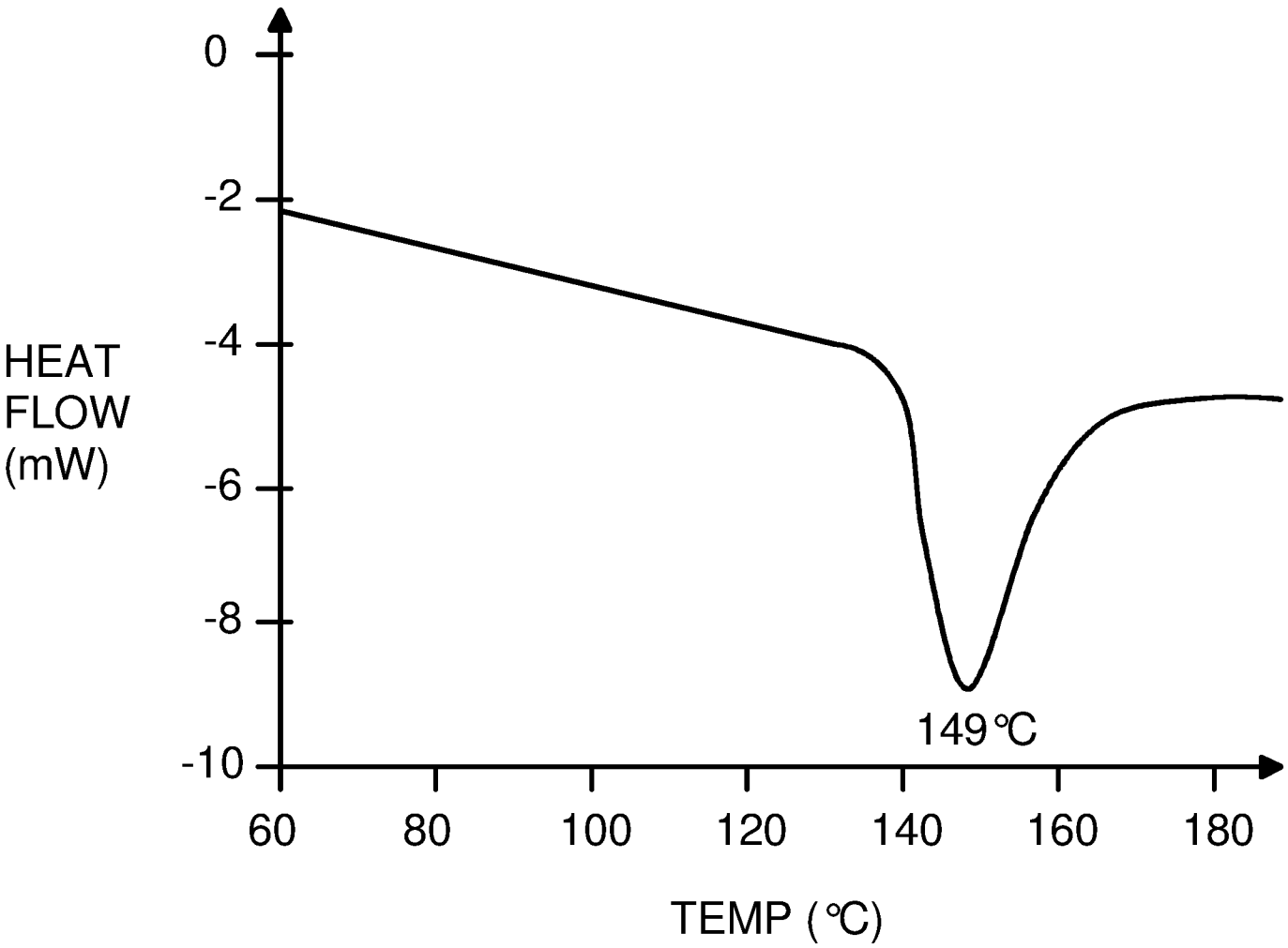
FIG. 18 is a heat flow diagram of a Sn—Bi alloy that was co-deposited with reagents A, B, and C as described earlier.

FIG. 18 is a heat flow diagram of a Sn—Bi alloy that was co-deposited with reagents A, B, and C as described earlier. As the temperature is raised, heat flows at a steadily increasing rate until a large spike occurs around 149° C. as the alloy melts. Thus a melting point of 149° C. is obtained for the Sn—Bi alloy. This is slightly above the melting point of 139° C. at the eutectic of 58% Bi by weight. A melting point of 149° C. is below the target of 180° C. where warpage of 3D packages may start to occur. Thus the co-deposition of Sn and Bi achieves a low melting point that is compatible with 3D packaging.

ALTERNATE EMBODIMENTS

Several other embodiments are contemplated by the inventors. For example many combinations and variations of reagent C molecule 50 are possible. Reagent C molecule 50 can have a defined structure such as:

$$CH_3[(X1)_{a1}—Y1]_{b1}—[(X2)_{a2}—Y2]_{b2}—Z$$

Wherein a1≥3; b1≥1; a2, b2≥0.

X1 and X2 are two instances of X, hydrophobic tail 54. Y1 and Y2 are two instances of Y, hydrophilic end 52. X2 and Y2 are optional. X1 does not have to be the same as X2, and Y1 does not have to be the same as Y2.

X (X1, X2) is the hydrophobic part, such as hydrophobic tail 54, and is an aliphatic or alkyl group of only carbon C and hydrogen H atoms.

X can be a single linear chain of methylene groups, $—(CH_2)_n—$, where n is 1 or more, or ideally for a longer tail, n is 12 or more. Larger values of n produce longer hydrophobic tails 54 that can increase the distance the hydrogen gas is removed from the electrode surface. Longer tails may also hold more hydrogen gas than shorter tails.

Rather than a single chain of $CH_2$ groups, X could also have branches, so X could be:

$$—(CH_2)_m CH(CH_3(CH_2)_l)(CH_2)_o—$$

Where m, l, o≥0, or X may include carbon-carbon double bonds, such as:

$$—(CH{=}CH)_k— \text{ where } k≥0.$$

Also, X may have a cyclic carbon ring without double bonds, such as a 5-carbon ring (cyclopentane). Six carbon ring (cyclohexane), seven carbon ring (cycloheptane), etc.:

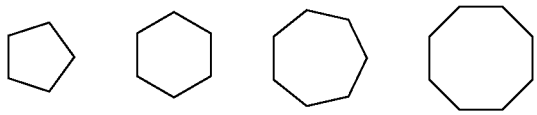

X could also contain one or more aromatic rings that have one or more carbon-carbon double bonds in the ring, such as cyclopentadiene, benzyl, indene, and anthracene:

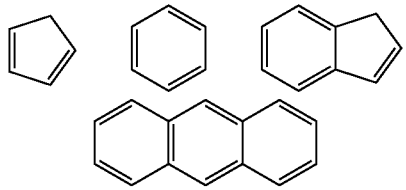

X may contain any or all of these variations in a single reagent C molecule 50.

Y is the hydrophilic part, such as hydrophilic end 52, and is an organic group of carbon C and hydrogen H atoms that also contains one or more heteroatoms or heteroatom groups such as ether —O—, amines —NH—, sulfur —S—, amide —(C═O)NH—, or ester —(C═O)—O—. Although an ester is slightly soluble in water, a small amount of ester can be used within hydrophilic end 52 in some embodiments.

Z is the cap structure and is hydrophilic when Z is a single hydrogen atom H, and hydrophilic when Z is-$CH_3$ or a longer aliphatic structure such as a second hydrophobic tail 54. Z can be another X structure, either the same as the first X structure or a different X structure.

While a single hydrophobic tail 54 has been shown bonded to a single hydrophilic end 52, each hydrophilic end 52 could have two or more hydrophobic tails 54 when structure Z has a long aliphatic chain. These additional hydrophobic tails 54 can sweep more $H_2$ gas molecules 40 away from surface 130 and thus may be more efficient when used as reagent C molecule 50.

The number of reagent A molecules 22 and reagent B molecules 24 that bind to each $Bi^{3+}$ ions 20 can vary and is not limited to the three shown in FIG. 6. Some water molecules or OH ions could also bind to $Bi^{3+}$ ions 20 or $Sn^{2+}$ ions 30. At equilibrium there may be a mixture of various complexes and states and intermediates.

While Reagent A has been described as nitric, sulfuric, carboxylic, sulfonic, or phenyl acid, reagent A could be a larger molecule that has a nitric acid group, or that has a sulfonic, carboxylic, or phenyl acid group at the end of a larger organic molecule. Reagent A can be inorganic or organic. Acids such as reagent A tend to be larger molecules than reagent B molecules, but not as large as reagent C molecules.

Different desired ranges of % Bi may be substituted for different melting points of the desired alloy. Less controllable process conditions may require a wider range of % Bi, or the range may need to be reduced if warpage occurs even at the target melting point to obtain a lower melting point alloy of Sn—Bi.

Various operating conditions are possible, such as temperature, voltage or current, concentrations of reagent A, reagent B, and reagent C. For example, group reagent C in the co-electrodeposition bath is in the range of 0.01 to 10 g/L and has a structure of $CH_3[(X)_{a1}—Y]_{b1}—[(X)_{a2}—Y]_{b2}—Z$ ($a_1 \geq 3$; $b_1 \geq 1$; $a_2$, $b_2$ . . . $a_n$, $b_n \geq 0$).

There is at least one kind of Sn salt and one kind of Bi salt in the co-electrodeposition bath in the range of 1 to 100 g/L.

There is at least one acid (reagent A) included in the co-electrodeposition bath in the range of 1 to 40 g/L or 0.1 to 10 g/L.

There could be chemicals with unsaturated double bonds such as aldehydes, ketones and imines, thiophene (reagent B) in the co-electrodeposition bath in the range of 1 to 100 g/L or 0.1 to 10 g/L.

The electroplating current within the electrolyte may be in the range of 0.5~5 A.

The electroplating temperature within the electrolyte may be 20~65° C.

There could be a buffer solution included in the co-electrodeposition bath in the range of 0.1~10 g/L. There also could be a stabilizer in the co-electrodeposition bath in the range of 0.1~10 g/L. Other additives for various purposes could be added to the co-electrodeposition bath, electrolyte bath 132.

The micro-pillars could be connected to the negative power supply through internal traces within chip 102 to allow these micro-pillars or solder pads 102 to be electrodeposited with Sn—Bi. A holder, metal clamp, or other device could be used to make electrical connection to the micro-pillars or pads to be deposited upon.

Various theories of chemical and other interactions have been presented as best understood by the inventors. However, actual physical mechanisms may differ from these theories. The theories may be simplifications and may not hold true in all circumstances. However these theories have been presented to better understand the inventors' concepts. Reagents may change when in solution in various ways, such as by donating a proton $H^+$ or through other reactions with water molecules and other molecules. Reagents may attach to ions or to the cathode surface using mechanisms that are weaker than chemical bonds. Various states may exist in equilibrium.

The eutectic diagrams, eutectic points, and melting points may differ depending on text methodology. For example, there are many versions of melting point detection. Many studies consider the starting point of the peak as the melting point, which is around 140° C. Then an alloy of 51.995% Bi using the peak value is more accurate using this alternate methodology.

Terms such as up, down, above, under, horizontal, vertical, inside, outside, are relative and depend on the viewpoint and are not meant to limit the invention to a particular perspective.

The background of the invention section may contain background information about the problem or environment of the invention rather than describing prior art by others. Thus inclusion of material in the background section is not an admission of prior art by the Applicant.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. An electrolyte bath solution for co-depositing tin (Sn) and bismuth (Bi) comprising:

Bi3+ ions released from a bismuth salt into the electrolyte bath solution;

$Sn^{2+}$ ions released from a tin salt into the electrolyte bath solution;

a first reagent that is selected from the group consisting of a nitric acid, a sulfuric acid, a carboxylic acid, a sulfonic acid, and a phenyl acid;

a second reagent that is selected from the group consisting of an imine, a ketone, an aldehyde, and a thiophene;

wherein the first reagent and the second reagent form a complex with the $Bi^{3+}$ ions in the electrolyte bath solution; and a third reagent having a third reagent molecule that is an organic molecule having a hydrophilic end and a hydrophobic tail;

wherein the hydrophilic end has carbon atoms and hydrogen atoms and at least one heteroatom that is not carbon or hydrogen, wherein the hydrophilic end attaches to a surface of a cathode immersed in the electrolyte bath solution;

wherein the hydrophobic tail is an aliphatic chain having only carbon and hydrogen atoms, the hydrophobic tail attracting hydrogen gas generated at the surface of the cathode;

wherein the hydrophobic tail comprises a contiguous group of at least 17 carbon atoms;

wherein the at least one heteroatom in the hydrophilic end is an oxygen atom, a nitrogen atom, or a sulfur atom, and the hydrophilic end has no more than 5 oxygen atoms; and wherein the third reagent molecule is synthesizable by a reflux reaction of a polymer molecule with two amine ends and two chlorinated hydrocarbon molecules, each chlorinated hydrocarbon molecule having a side branch between a long aliphatic chain and a chlorine end, whereby the hydrophobic tail of the third reagent molecule attracts hydrogen gas to remove hydrogen gas from near the surface of the cathode to permit uniform co-deposition of $Bi^{3+}$ ions and $Sn^{2+}$ ions on the surface of the cathode without hinderance from the hydrogen gas.

2. The electrolyte bath solution of claim 1 wherein the hydrophilic end is an amine, an amide, an ether, or an ester.

3. The electrolyte bath solution of claim 1 wherein the first reagent is a first reagent molecule that is larger in size than a second reagent molecule of the second reagent;

wherein the second reagent binds to the $Bi^{3+}$ ions in spaces between first reagent molecules wherein the spaces are too small for an additional first reagent molecule to bind to the $Bi^{3+}$ ion.

4. The electrolyte bath solution of claim 2 wherein the first reagent and the second reagent forming the complex with the $Bi^{3+}$ ions in the electrolyte bath solution causes a standard electrode potential difference between the $Bi^{3+}$ ions and the $Sn^{2+}$ ions to be reduced to less than 100 millivolts.

5. The electrolyte bath solution of claim 1 wherein the third reagent molecule has a structure of:

$$CH_3[(X1)_{a1}—Y1]_{b1}—[(X2)_{a2}—Y2]_{b2}—Z$$

wherein a1>3; b1>1; a2>0, b2>0, X1 is the hydrophobic tail, Y1 is the hydrophilic end, X2 is a second hydrophobic tail, Y2 is a second hydrophilic end, and Z is hydrogen or an alkyl group.

6. The electrolyte bath solution of claim 5 wherein X1 and X2 are each selected from the group consisting of:

$—CH_2—$, $—(CH_2)_m CH(CH_3(CH_2)_l)(CH_2)_o—$, wherein $m, l, o \geq 0$, $—(CH{=}CH)_k—$, wherein $k \geq 0$, a cyclic carbon ring without double bonds;

a carbon and hydrogen group having one or more aromatic rings that have one or more carbon-carbon double bonds in the aromatic ring;

a combination of any of the above;

wherein Y1 and Y2 are each selected from the group consisting of:

an amide;

an ester;

an oxygen atom;

a nitrogen atom.

7. The electrolyte bath solution of claim 1 wherein the polymer molecule is $NH_2$-PEG-$NH_2$ (Amine-PEG-Amine), where PEG is a polyethylene glycol.

8. The electrolyte bath solution of claim 1 wherein the third reagent molecule is synthesizable using an esterification reaction of polyethylene glycol (PEG) and an alkylbenzoic acid;

wherein the alkylbenzoic acid forms the hydrophobic tail having an aliphatic chain with an aromatic ring;

wherein the PEG forms the hydrophilic end of the third reagent molecule.

9. The electrolyte bath solution of claim 1 wherein the hydrophobic tail comprises a contiguous group of at least 20 carbon atoms and the hydrophilic end comprises at least one heteroatom atom and has fewer contiguous carbon atoms than the hydrophobic tail, wherein the at least one heteroatom is oxygen or nitrogen.

10. An electrolyte bath solution for co-depositing tin (Sn) and bismuth (Bi) comprising:

$Bi^{3+}$ ions released from a bismuth salt into the electrolyte bath solution;

$Sn^{2+}$ ions released from a tin salt into the electrolyte bath solution;

a first reagent that is selected from the group consisting of a nitric acid, a sulfuric acid, a carboxylic acid, a sulfonic acid, and a phenyl acid;

a second reagent that is selected from the group consisting of an imine, a ketone, an aldehyde, and a thiophene;

wherein the first reagent and the second reagent form a complex with the $Bi^{3+}$ ions in the electrolyte bath solution; and a third reagent having a third reagent molecule that is an organic molecule having a hydrophilic end and a hydrophobic tall;

wherein the hydrophilic end has carbon atoms and hydrogen atoms and at least one heteroatom that is not carbon or hydrogen, wherein the hydrophilic end attaches to a surface of a cathode immersed in the electrolyte bath solution;

wherein the hydrophobic tail is an aliphatic chain having only carbon and hydrogen atoms, the hydrophobic tail attracting hydrogen gas generated at the surface of the cathode;

wherein the hydrophobic tail comprises a contiguous group of at least 17 carbon atoms;

whereby the hydrophobic tail of the third reagent molecule attracts hydrogen gas to remove hydrogen gas from near the surface of the cathode to permit uniform co-deposition of $Bi^{3+}$ ions and $Sn^{2+}$ ions on the surface of the cathode without hinderance from the hydrogen gas;

wherein the at least one heteroatom in the hydrophilic end is an oxygen atom, a nitrogen atom, or a sulfur atom, and the hydrophilic end has no more than 5 oxygen atoms; and wherein the third reagent molecule is synthesizable by a condensation reaction of an aliphatic aldehyde and an ammonium group to generate an imine group, wherein the ammonium group is from a structure of a polypeptide.

11. The electrolyte bath solution for co-depositing tin (Sn) and bismuth (Bi) of claim 10 wherein a Sn—Bi alloy is deposited on exposed metal pads when the current is applied:

wherein the Sn—Bi alloy that is deposited has a melting point that is below 180° C.:

wherein the Sn—Bi alloy that is deposited has a percentage by weight of bismuth that is between 30% and 70%.

12. The electrolyte bath solution for co-depositing tin (Sn) and bismuth (Bi) of claim 11 wherein the Sn—Bi alloy that is deposited on the exposed metal pads has an improved uniformity when the third reagent is present than without the third reagent.

13. The electrolyte bath solution for co-depositing tin (Sn) and bismuth (Bi) of claim 10 wherein the hydrophobic tail has a longer length of a contiguous chain of carbon atoms than a total number of carbon atoms in a contiguous chain of carbon atoms in the hydrophilic end, wherein the first reagent is an alkyl sulfonic acid, and the second reagent is an aldehyde, a ketone, or an ammonium.

* * * * *